US009021957B1

(12) United States Patent
Farina et al.

(10) Patent No.: US 9,021,957 B1
(45) Date of Patent: May 5, 2015

(54) GUN-LAUNCHED NON-LETHAL PROJECTILE WITH SOLID PROPELLANT ROCKET MOTOR

(71) Applicants: Anthony P. Farina, Hackettstown, NJ (US); Brian Wong, Hamburg, NJ (US)

(72) Inventors: Anthony P. Farina, Hackettstown, NJ (US); Brian Wong, Hamburg, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/169,500

(22) Filed: Jan. 31, 2014

(51) Int. Cl.
*F42B 15/10* (2006.01)
*F42B 10/38* (2006.01)
*F42B 12/02* (2006.01)

(52) U.S. Cl.
CPC ..... *F42B 15/10* (2013.01); *F42B 12/02* (2013.01)

(58) Field of Classification Search
USPC ..... 102/439, 376, 443, 444, 447, 490, 498, 102/502, 529, 287, 293
See application file for complete search history.

(56) References Cited

U.S. PATENT DOCUMENTS 3,698,321 A * 10/1972 Wall ..... 102/374
3,750,979 A * 8/1973 Nelms et al. ..... 244/3.24
4,589,342 A * 5/1986 Rousseau ..... 102/377
5,221,809 A * 6/1993 Cuadros ..... 102/439

* cited by examiner

*Primary Examiner* — Jonathan C Weber
(74) *Attorney, Agent, or Firm* — Henry S. Goldfine

(57) ABSTRACT

A gun-launched, non-lethal, anti-personnel projectile includes a variable thrust, solid propellant rocket motor. The rocket motor has a variable thrust profile that maintains a substantially constant kinetic energy of the projectile below a lethal threshold from a range of about 5 meters to about 400 meters.

16 Claims, 9 Drawing Sheets

GUN-LAUNCHED NON-LETHAL PROJECTILE WITH SOLID PROPELLANT ROCKET MOTOR

STATEMENT OF GOVERNMENT INTEREST

The inventions described herein may be manufactured, used and licensed by or for the United States Government.

BACKGROUND OF THE INVENTION

The invention relates in general to non-lethal anti-personnel projectiles, and in particular to longer range non-lethal anti-personnel projectiles.

Non-lethal projectiles are designed to impact human beings without killing or seriously injuring them. So, non-lethal projectiles must have an impact momentum that is below a lethal threshold for humans.

In existing gun-launched non-lethal projectiles, the impact momentum at close range is limited by limiting the launch velocity of the projectile and/or the mass of the projectile. Limiting either the velocity or the mass affects the ability of the projectile to perform at longer ranges. For example, a low mass can result in a low ballistic coefficient and a consequent great loss of velocity. A low launch velocity results in even lower downrange velocities, longer flight times, and more gravity drop. In either case, the non-lethal projectile will not perform as needed at longer ranges, for example, up to 400 meters.

A need exists for a gun-launched non-lethal anti-personnel projectile with non-lethal performance at both close and long ranges.

SUMMARY OF INVENTION

One aspect of the invention is a gun-launched, non-lethal, anti-personnel cartridge. The cartridge includes a casing with a base and propellant disposed in the casing. A non-lethal projectile is disposed in the casing forward of the propellant and has a central longitudinal axis. The projectile includes a soft nose and a variable thrust, solid propellant rocket motor disposed aft of the nose. The rocket motor has a variable thrust profile that maintains a substantially constant kinetic energy of the projectile below a lethal threshold from a range of about 5 meters to about 400 meters.

In one embodiment, the rocket motor includes a cylindrical combustion chamber centered on the central longitudinal axis and concentrically surrounded by a first propellant in the form of a tube. The first propellant is concentrically surrounded by a second propellant in the form of a tube. The burn rate and thrust of the first propellant are less than the burn rate and thrust of the second propellant.

In another embodiment, the rocket motor includes a cylindrical combustion chamber centered on the central longitudinal axis and surrounded by a first propellant in the form of a tube and a second propellant in the form of a tube. The first and second propellants are disposed axially adjacent each other and centered on the central longitudinal axis. The burn rate and thrust of the first propellant are less than the burn rate and thrust of the second propellant.

An additional embodiment of the rocket motor includes a plurality of motor segments that are concentric with the central longitudinal axis and arranged in series along the central longitudinal axis. Each motor segment is symmetric around the central longitudinal axis. Each motor segment includes solid rocket motor propellant disposed symmetrically around a respective motor segment combustion chamber. Each motor segment has a different burn rate and thrust.

The motor segment combustion chambers may have different cross-sectional areas. The aft-most motor segment may have a burn rate and a thrust that is less than burn rates and thrusts of all the other motor segments. The burn rates and thrusts of each motor segment may increase from the aft-most segment to a forward-most segment.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

FIG. 6B is an end view of the aft segment of the motor of FIG. 6A.

FIG. 6C is an end view of the middle segment of the motor of FIG. 6A.

FIG. 6D is an end view of the forward segment of the motor of FIG. 6A.

DETAILED DESCRIPTION

Figure 1:
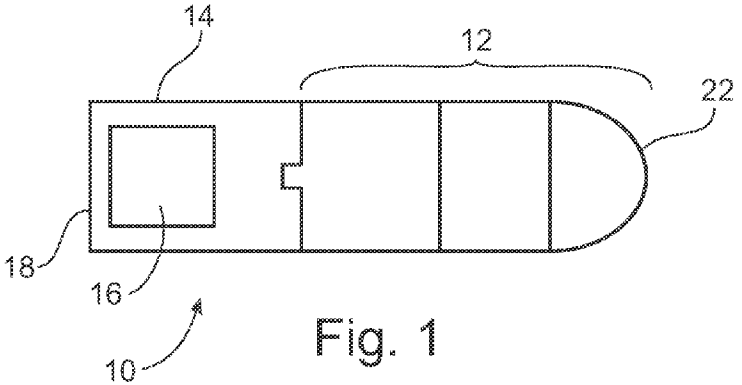
FIG. 1 is a schematic cutaway side view of one embodiment of a gun-launched, non-lethal, anti-personnel cartridge.

There are many measurements of the lethality of a projectile and no universal agreement exists. For non-lethal projectiles designed to neutralize humans by impact force, the lethality of the projectile depends on many variables including, but not limited to, the size and weight of the projectile, the geometry of the projectile, the density of the projectile, and the velocity of the projectile. In addition, the lethality of a projectile may depend on factors that vary between humans, such as, body size, weight, individual fitness, etc. For the purpose of the present invention, the kinetic energy of the projectile is the measurement of lethality and the variable of interest. The kinetic energy is one-half of the product of the projectile mass and the square of the projectile's velocity.

In prior art projectiles, great care was used to maintain a constant thrust throughout the flight time of the projectile. Typically, solid rocket motor propellant with a star-shaped cross-section was used so that, as the motor propellant burned away, the exposed surface area of the propellant remained close to constant. The constant exposed surface area maintained the thrust close to constant. There were no considerations given to the change of the projectile's mass as a function of flight time or to the maintenance of constant projectile kinetic energy.

The novel gun-launched projectile meets the need for a non-lethal projectile that is effective against personnel at a variety of ranges. The range of effective use may be, for example, from about 5 meters to about 400 meters. The projectile is launched at a velocity that is high enough to provide stable flight and render the projectile effective at close range. The projectile includes a rocket motor that ignites during or soon after launch of the projectile. The rocket motor may burn in phases. The goal is to maintain the projectile's kinetic energy at or below the non-lethal threshold.

The burn rates and thrust imparted to the non-lethal projectile may be varied according to need. For effective non-lethal performance at close in ranges, the initial burn phase may have a low thrust and burn rate. To counteract the projectile's natural tendency to slow down at longer ranges, higher thrust and burn rates may be needed to increase velocity. As flight time increases and projectile mass decreases, additional velocity is needed to maintain constant kinetic energy.

As the rocket motor propellant burns away, the propellant cross-section may vary. The differing thrusts may be enabled by the use of differing cross-sections of propellant. As an alternative to or in addition to varying the cross-section of the propellant, propellants having differing chemical compositions and geometries may be used to produce thrust that varies with projectile flight time. Varying the thrust may increase the projectile's performance at longer ranges, without exceeding the non-lethal threshold at close range. As the rocket propellant burns away, the mass of the projectile decreases. The decreasing mass tends to decrease the probability of exceeding the non-lethal threshold. The thrust v. time profile, flight drag, projectile mass, and projectile impact area may be balanced to provide non-lethal effects at both short and long range.

As rocket propellant is burned, the mass of the projectile decreases. The thrust must be varied so that the impact kinetic energy remains as near as possible to a predetermined non-lethal threshold. The rocket motor propellant has a negative mass flow rate as the motor burns. The total mass loss due to motor burn is the mass flow rate integrated over time. The thrust level may be tailored in accordance with the mass flow rate.

Figure 2:
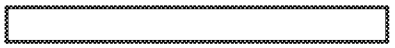
Fig. 2 Prior Art
FIG. 2 is a schematic side view of a gun for launching the cartridge of FIG. 1.

FIG. 1 is a schematic cutaway side view of one embodiment of a gun-launched, non-lethal, anti-personnel cartridge 10. Cartridge 10 includes a case 14 having a base 18. Propellant 16 is disposed in case 14. A non-lethal projectile 12 is disposed in cartridge 10 forward of propellant 16. FIG. 2 is a schematic side view of a gun 20 for launching cartridge 10 in a known manner by igniting propellant 16 in case 14.

Figure 3:
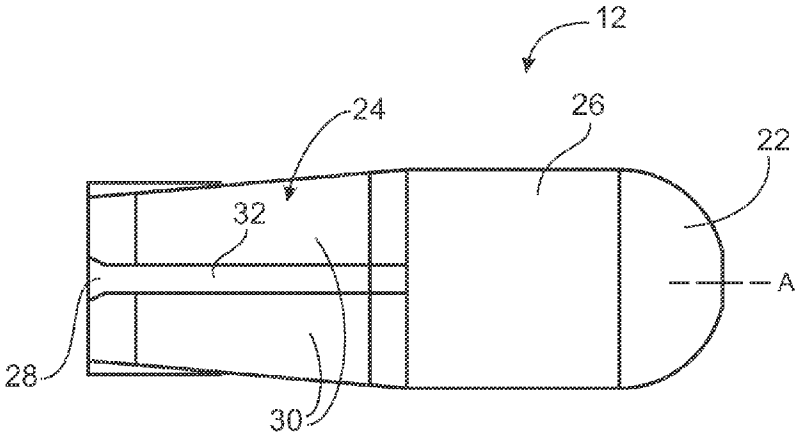
FIG. 3 is a schematic cutaway side view of one embodiment of a projectile for use with the cartridge of FIG. 1.

FIG. 3 is a schematic cutaway side view of one embodiment of non-lethal projectile 12. Projectile 12 has a central longitudinal axis A. The forward end of projectile 12 is a soft nose 22 made of, for example, foam, rubber, or plastic. A variable thrust, solid propellant rocket motor 24 is disposed aft of nose 22. A body portion 26 may be disposed between nose 22 and motor 24. Body portion 26 may contain, for example, known non-lethal effectors. Rocket motor 24 includes solid propellant 30. A void or combustion chamber 32 leads to a conventional nozzle 28 for exhausting gases produced by the rocket motor 24. Combustion chamber 32 is centered on axis A. Solid propellant 30 may be ignited by the burning of propellant 16 in case 14.

Variable thrust rocket motor 24 has a thrust profile that varies with flight time of projectile 12. As the rocket motor propellant 30 burns, the mass of projectile 12 decreases and the velocity increases. The thrust profile of motor 24 maintains a substantially constant kinetic energy of projectile 12 from a range of, for example, about 5 meters to about 400 meters. The substantially constant kinetic energy is maintained below a lethal threshold for humans. In one embodiment of projectile 12, the caliber or projectile 12 is 40 mm and the lethal threshold is about 58 foot pounds.

Figure 4:
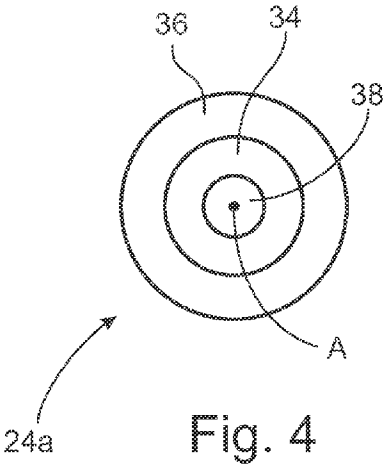
FIG. 4 is an end view of an embodiment of a variable thrust, solid propellant rocket motor.

Various configurations of rocket motor 24 may be used to vary thrust and maintain constant kinetic energy. Variable thrust may be attained, for example, by dividing motor 24 into stages with different propellants and/or different geometries of propellants. For example, FIG. 4 is an end view of a variable thrust solid propellant rocket motor 24*a* having two concentric, cylindrical tubes of propellant 34 and 36 centered around a cylindrical void or combustion chamber 38. Chamber 38 and propellants 34, 36 are concentric with axis A. Propellant 34, which is burned first, has a lower burn rate and a lower thrust level than propellant 36. Propellants 34, 36 may be known propellants. More than two concentric tubes of propellant may be used.

Figure 5:
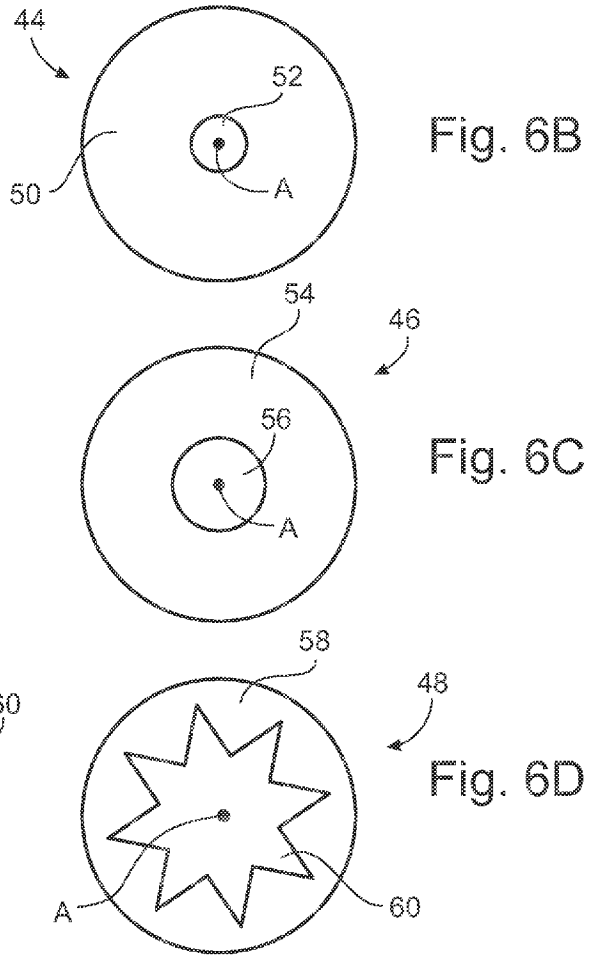
FIG. 5 is a longitudinal sectional view of an embodiment of a variable thrust, solid propellant rocket motor.
Figure 5:
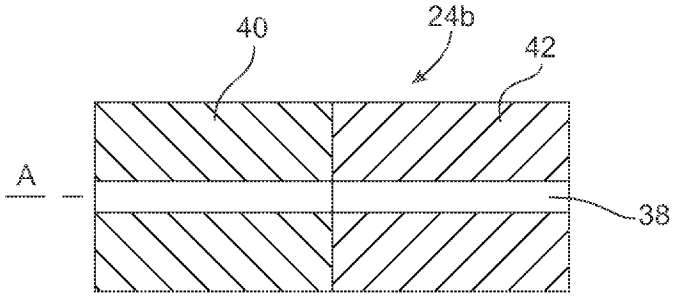

FIG. 5 is a side sectional view of a variable thrust solid propellant rocket motor 24*b* with cylindrical combustion chamber 38 and two cylindrical tubes of propellant 40, 42 disposed axially adjacent each other. Propellant 40 is adjacent the nozzle (not shown). Chamber 38 and propellants 40, 42 are concentric with axis A. Propellant 40, which is burned first, has a lower burn rate and a lower thrust level than propellant 42. Propellants 40, 42 may be known propellants. Additional tubes of propellant may be disposed serially along axis A.

Figure 6A:
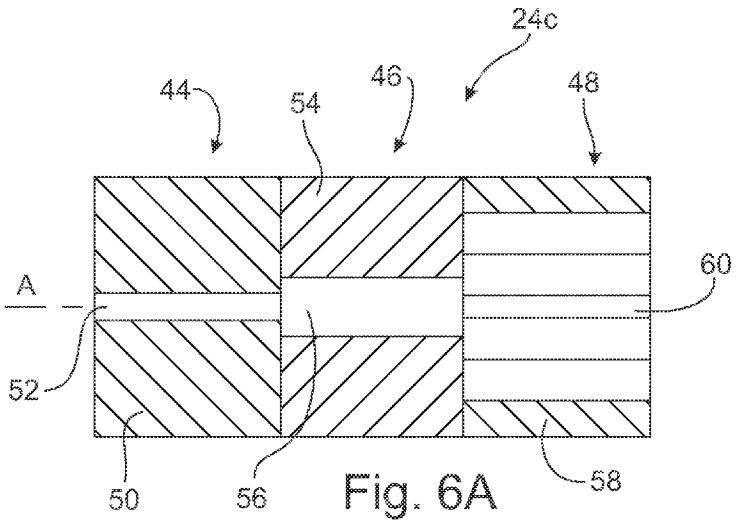
FIG. 6A is a longitudinal sectional view of an embodiment of a variable thrust, solid propellant rocket motor.

FIG. 6A is a side sectional view of a variable thrust solid propellant rocket motor 24*c* having a plurality of segments, with three segments 44, 46, 48 being shown in FIG. 6A. Additional segments could be used in motor 24*c*. FIGS. 6B, 6C, and 6D are end views of segments 44, 46, 48, respectively. Each segment 44, 46, 48 is concentric with central longitudinal axis A. The segments are arranged in series along axis A and each segment is symmetric around axis A. Segment 44 includes solid rocket motor propellant 50 disposed symmetrically around a motor segment combustion chamber 52. Segment 46 includes solid rocket motor propellant 54 disposed symmetrically around a motor segment combustion chamber 56. Segment 48 includes solid rocket motor propellant 58 disposed symmetrically around a motor segment combustion chamber 60. Each motor segment 44, 46, 48 has a different burn rate and thrust.

In one embodiment, each motor segment combustion chamber 52, 56, 60 has a different cross-sectional area. As seen in FIGS. 6A-D, chamber 52 is a cylindrical void, chamber 56 is a cylindrical void with a larger diameter than chamber 52, and chamber 60 is a star-shaped void. Of course, other shapes may be used for chambers 52, 56, and 60.

Solid rocket motor propellants 50, 54, 58 may have the same chemical composition or each may have a different chemical composition. In one embodiment, the burn rate and thrust of each motor segment increases from the aft of the motor 24*c* to the front of motor 24*c*. For example, the aft-most motor segment 44 has the lowest burn rate and thrust and the middle motor segment 46 has a burn rate and thrust that is greater than that of segment 44 but less than that of the forward segment 48.

Figure 7:
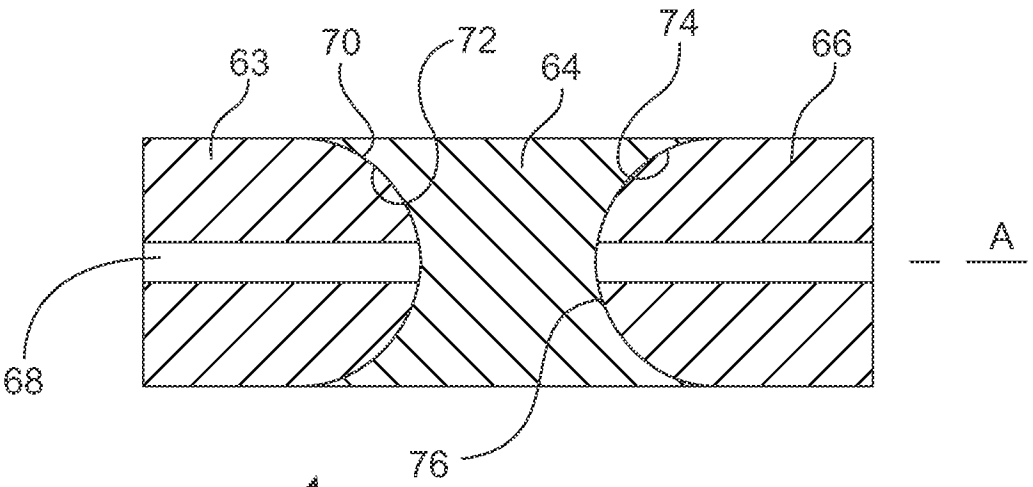
FIG. 7 is a longitudinal sectional view of an embodiment of a variable thrust, solid propellant rocket motor.

The interfaces between segments 44, 46, 48 may be other than abutting planar surfaces. For example, FIG. 7 shows a variable thrust solid propellant rocket motor 24*d* having a plurality of propellant segments 62, 64, 66 and a combustion chamber 68. Segments 62, 64, 66 and chamber 68 are symmetric about axis A. Segment 62 has a concave forward surface 70 that mates with a complementary convex aft surface 72 of segment 64. Segment 64 has a convex forward surface 74 that mates with a complementary concave aft surface 76 of segment 66. Of course, segment interfaces with other geometric shapes may be used.

Figure 8:
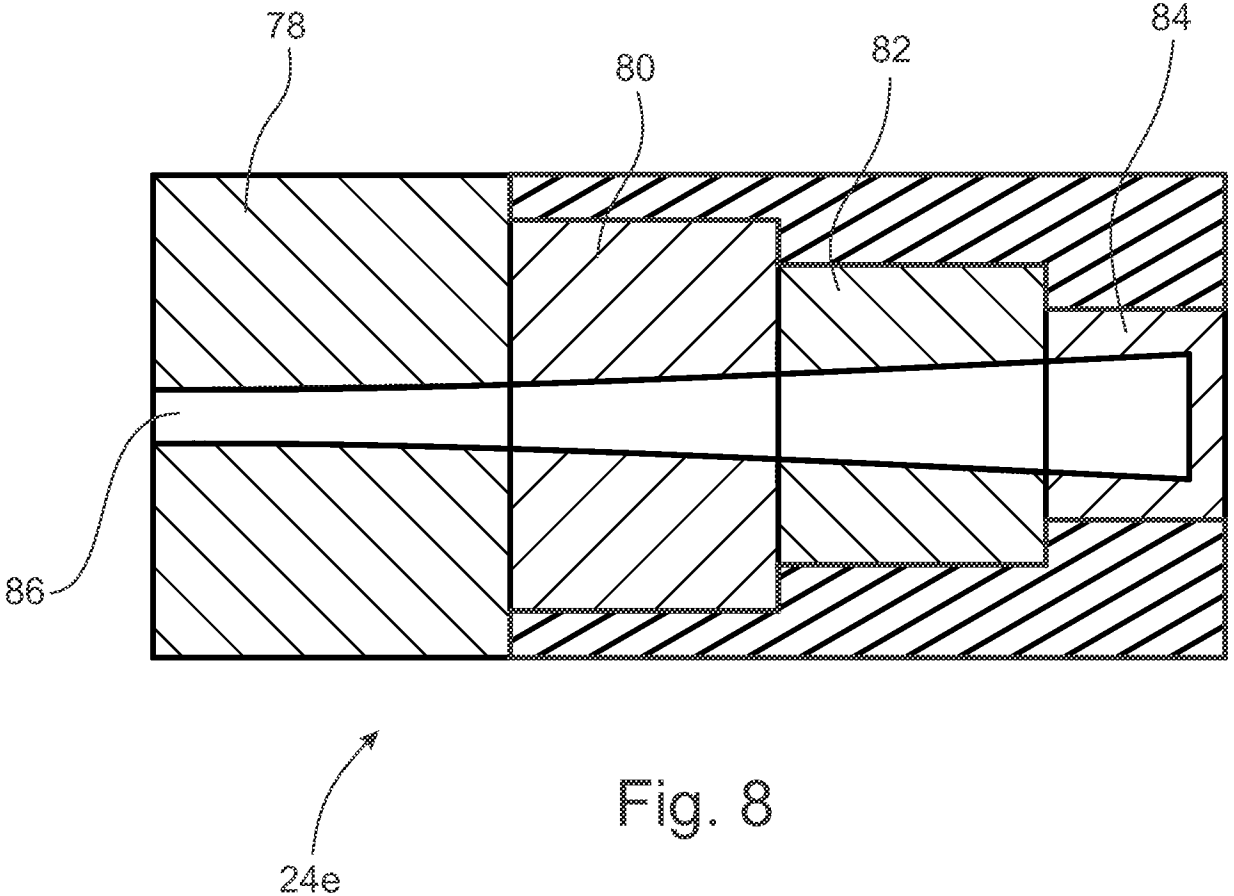
FIG. 8 is a longitudinal sectional view of an embodiment of a variable thrust, solid propellant rocket motor.

FIG. 8 is a longitudinal sectional view of one embodiment of a variable thrust, solid propellant rocket motor 24*e*. Motor 24*e* includes a plurality of tubular propellant segments 78, 80, 82, 84 that decrease in cross-sectional area from aft to front. The combustion chamber 86 increases in cross-sectional area from aft to front. The propellant segments 78, 80, 82, 84 may have the same chemical composition or have different chemical compositions.

Figure 9:
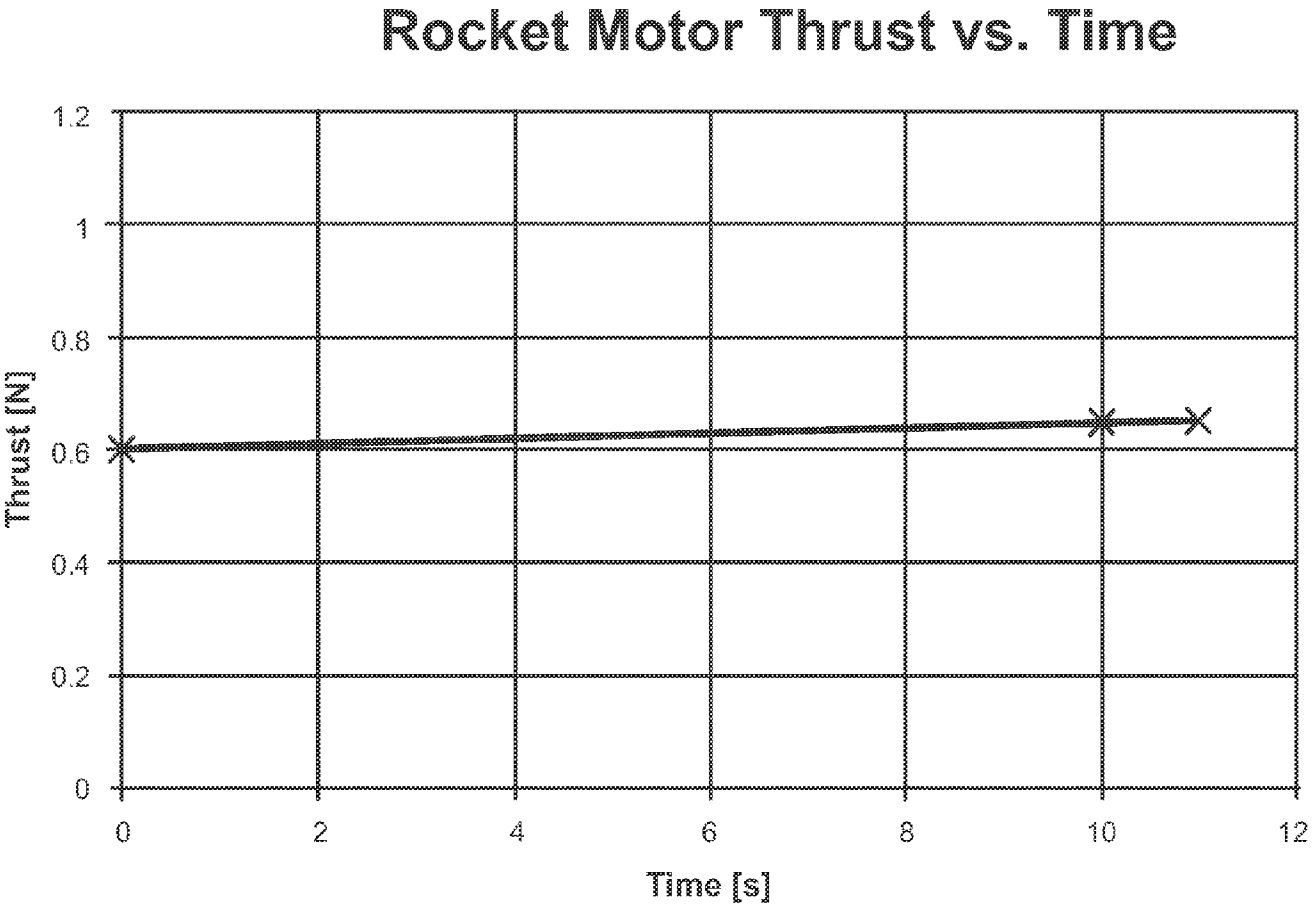
FIG. 9 is a graph of rocket motor thrust (Newtons) as a function of flight time (seconds).
Figure 10:
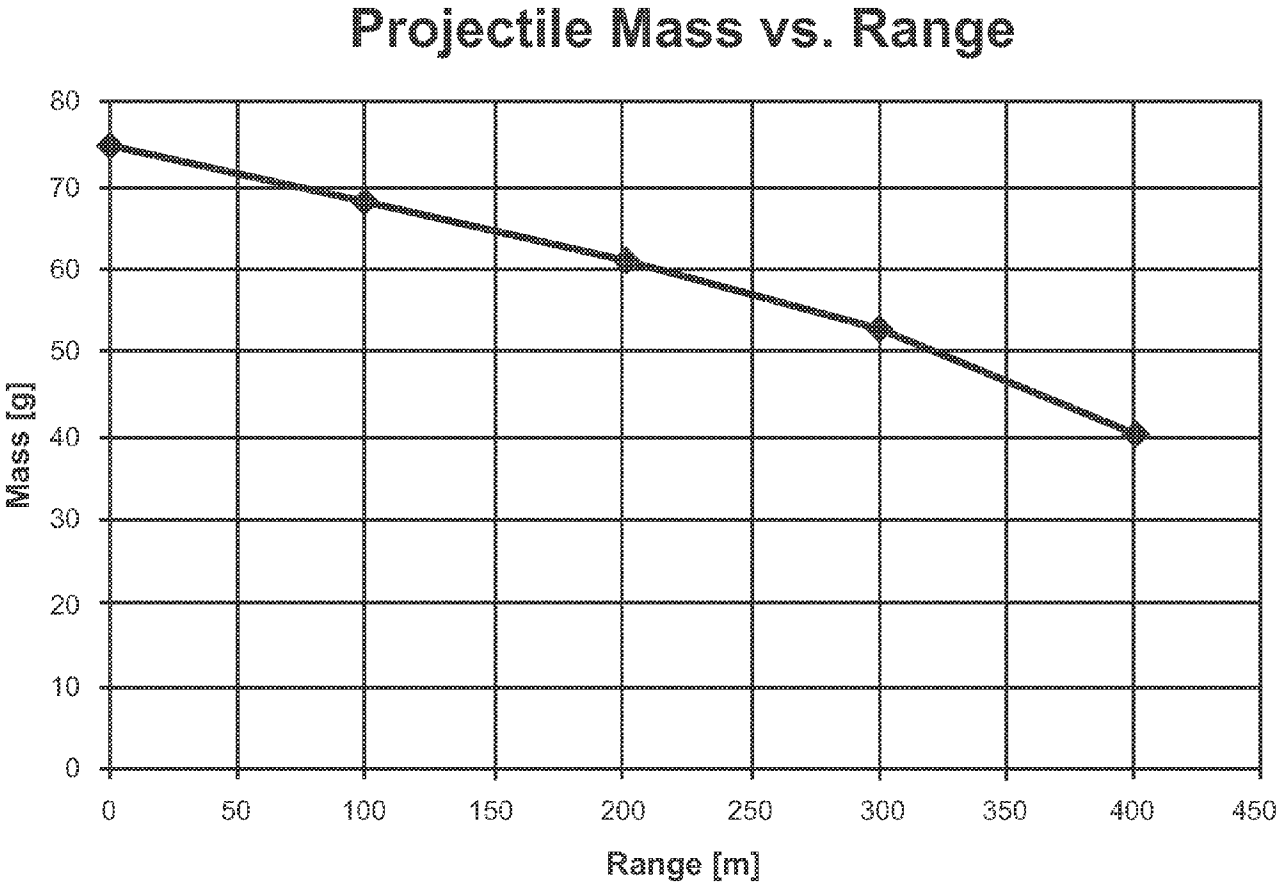
FIG. 10 is a graph of projectile mass (grams) as a function of flight distance (meters).
Figure 11:
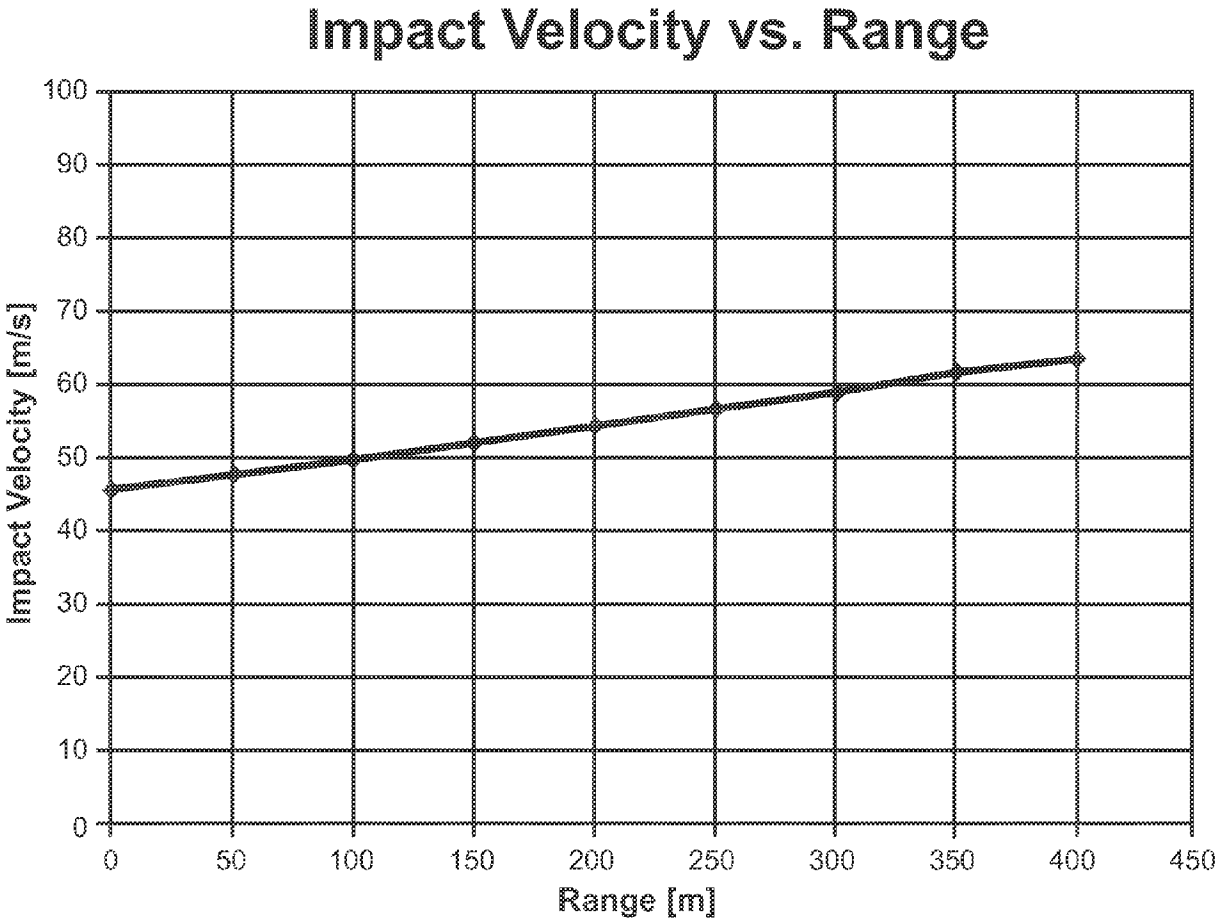
FIG. 11 is a graph of projectile impact velocity (meters/second) as a function of flight distance (meters).
Figure 12:
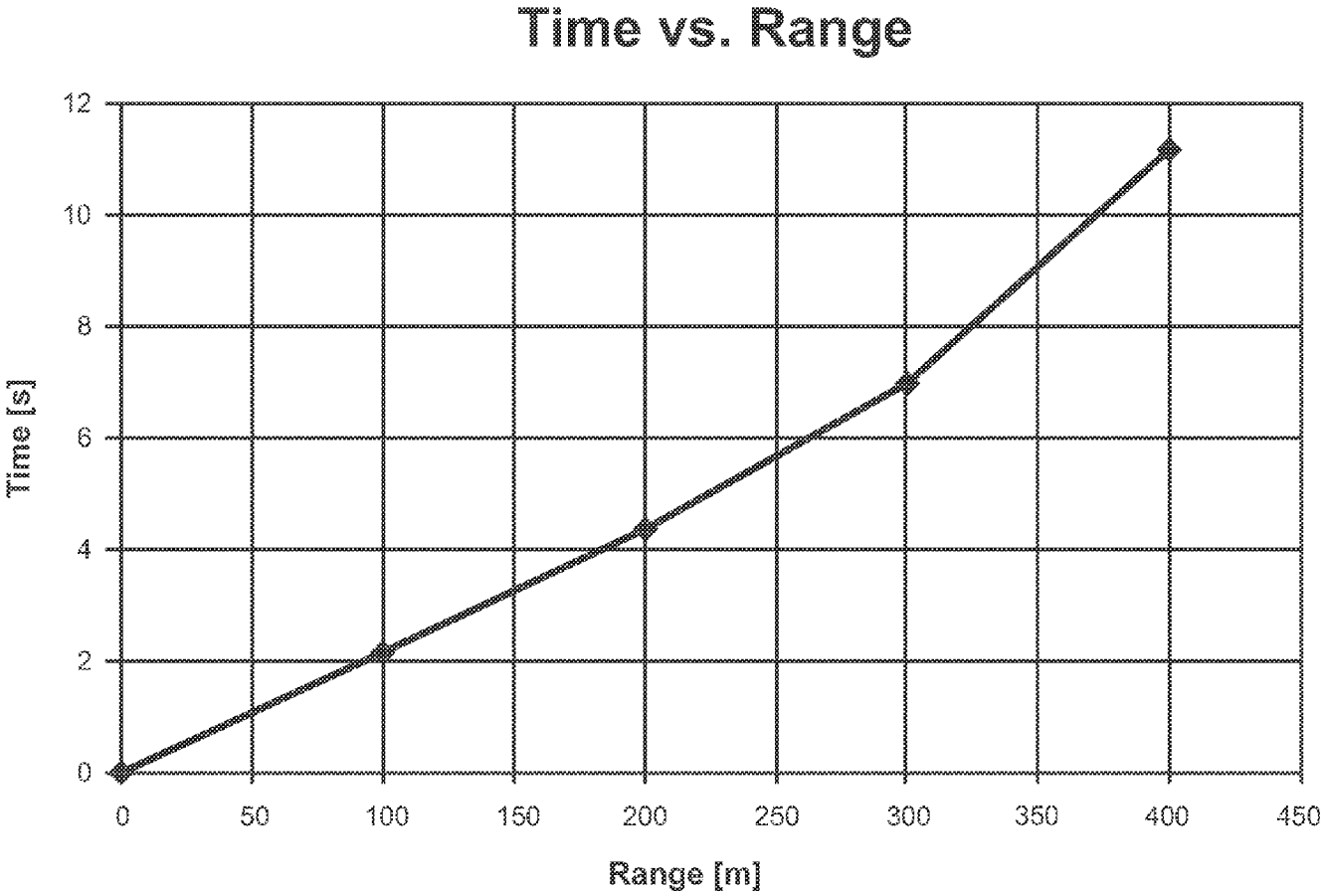
FIG. 12 is a graph of flight time (seconds) as a function of flight distance (meters).
Figure 13:
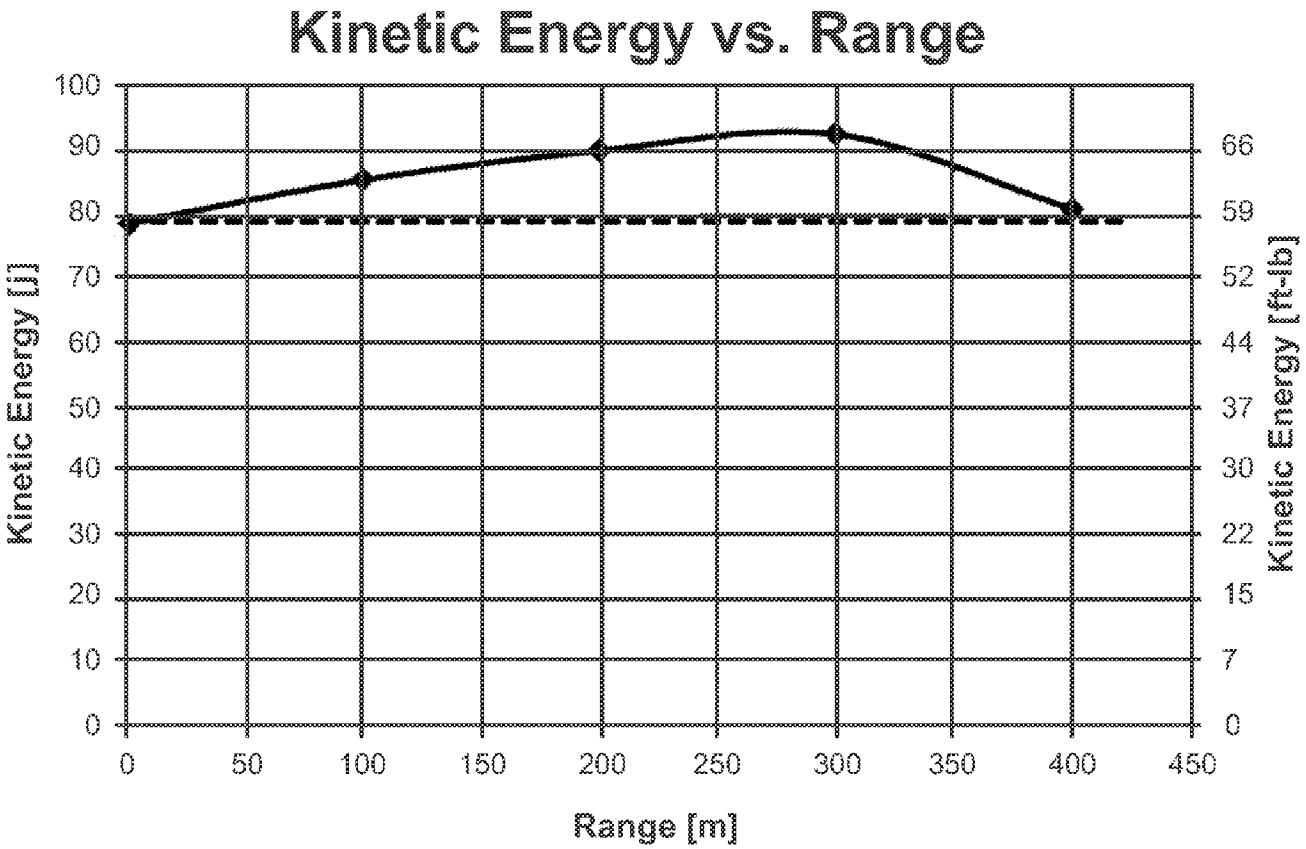
FIG. 13 is a graph of projectile kinetic energy (Joules and foot pounds) as a function of flight distance (meters).

Computerized modeling and simulation was performed to determine a target candidate for a 40 mm non-lethal projectile. The most promising candidate was a 75 gram projectile with a variable thrust that increases with flight time. FIG. 9 shows the rocket motor thrust (Newtons) as a function of flight time (seconds). FIG. 10 shows the decreasing mass (grams) of the projectile as a function of flight distance or range (meters). FIG. 11 shows the impact velocity (meters/second) as a function of flight distance (meters). FIG. 12 shows the time of flight (seconds) as a function of flight distance (meters). FIG. 13 shows the kinetic energy (Joules and foot pounds) as a function of flight distance (meters). The projectile's kinetic energy as shown in FIG. 13 is somewhat greater than the target level. If desired, the kinetic energy can be adjusted lower by, for example, slightly reducing the muzzle velocity of the projectile and/or slightly reducing the initial mass of the projectile, and/or varying the rocket motor thrust. The muzzle velocity may be reduced by changing the amount or composition of propellant 16 (FIG. 1) in cartridge case 14.

While the invention has been described with reference to certain embodiments, numerous changes, alterations and modifications to the described embodiments are possible without departing from the spirit and scope of the invention as defined in the appended claims, and equivalents thereof.

What is claimed is:

1. A gun-launched, non-lethal, anti-personnel cartridge, comprising:

a casing with a base;

propellant disposed in the casing; and a non-lethal projectile disposed in the casing forward of the propellant and having a central longitudinal axis;

the projectile including a soft nose and a variable thrust, solid propellant rocket motor disposed aft of the nose, the rocket motor having a variable thrust profile that maintains a substantially constant kinetic energy of the projectile below a lethal threshold from a range of about 5 meters to about 400 meters.

2. The projectile of claim 1, wherein the rocket motor includes a nozzle at an aft end.

3. The projectile of claim 2, wherein the nose is made of one of foam, rubber, and plastic.

4. The projectile of claim 3, wherein a caliber of the projectile is 40 mm.

5. The projectile of claim 3, wherein the rocket motor includes a cylindrical combustion chamber centered on the central longitudinal axis and concentrically surrounded by a first propellant in the form of a tube, the first propellant being concentrically surrounded by a second propellant in the form of a tube wherein a burn rate and thrust of the first propellant are less than a burn rate and thrust of the second propellant.

6. The projectile of claim 3, wherein the rocket motor includes a cylindrical combustion chamber centered on the central longitudinal axis and surrounded by a first propellant in the form of a tube and a second propellant in the form of a tube, the first and second propellants being disposed axially adjacent each other and centered on the central longitudinal axis, wherein a burn rate and thrust of the first propellant are less than a burn rate and thrust of the second propellant.

7. The projectile of claim 3, wherein the rocket motor includes a plurality of motor segments that are concentric with the central longitudinal axis and arranged in series along the central longitudinal axis, each motor segment being symmetric around the central longitudinal axis and each motor segment including solid rocket motor propellant disposed symmetrically around a respective motor segment combustion chamber, wherein each motor segment has a different burn rate and thrust.

8. The projectile of claim 7, wherein each motor segment combustion chamber has a different cross-sectional area.

9. The projectile of claim 8, wherein the solid rocket motor propellant of each motor segment has a same chemical composition.

10. The projectile of claim 7, wherein the solid rocket motor propellant of each motor segment has a different chemical composition.

11. The projectile of claim 7, wherein each motor segment combustion chamber has a different geometric shape.

12. The projectile of claim 7, wherein an aft-most motor segment has a burn rate and a thrust that is less than burn rates and thrusts of all the other motor segments.

13. The projectile of claim 12, wherein the burn rates and thrusts of each motor segment increase from the aft-most segment to a forward-most segment.

14. A method, comprising:

providing the gun-launched, non-lethal, anti-personnel cartridge of claim 1;

launching the non-lethal projectile; and maintaining the substantially constant kinetic energy of the projectile below the lethal threshold from the range of about 5 meters to about 400 meters.

15. The method of claim 14, wherein the step of providing includes providing the rocket motor with a plurality of motor segments that are concentric with the central longitudinal axis and arranged in series along the central longitudinal axis, each motor segment being symmetric around the central longitudinal axis and each motor segment including solid rocket motor propellant disposed symmetrically around a respective motor segment combustion chamber, wherein each motor segment has a different burn rate and thrust.

16. A gun-launched, non-lethal, anti-personnel cartridge, comprising:

a casing with a base;

propellant disposed in the casing; and a non-lethal projectile disposed in the casing forward of the propellant and having a central longitudinal axis;

the projectile including a soft nose and a variable thrust, solid propellant rocket motor disposed aft of the nose, the rocket motor having a variable thrust profile that maintains a substantially constant kinetic energy of the projectile below a lethal threshold from a range of about 5 meters to about 400 meters;

the rocket motor including a plurality of motor segments that are concentric with the central longitudinal axis and arranged in series along the central longitudinal axis, each motor segment being symmetric around the central longitudinal axis and each motor segment including solid rocket motor propellant disposed symmetrically around a respective motor segment combustion chamber, wherein each motor segment has a different burn rate and thrust and the burn rates and thrusts of each motor segment increase from the aft-most segment to a forward-most segment.

* * * * *